US007418912B2

(12) United States Patent
Morse et al.

(10) Patent No.: US 7,418,912 B2
(45) Date of Patent: Sep. 2, 2008

(54) STEERING SYSTEM AND AN ASSOCIATED VESSEL

(75) Inventors: Justin C. Morse, Ruckersville, VA (US); Lawrence E. Rainey, Barboursville, VA (US); Andre Richards, Charlottsville, VA (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 0 days.

(21) Appl. No.: 11/553,140

(22) Filed: Oct. 26, 2006

(65) Prior Publication Data

US 2008/0098942 A1 May 1, 2008

(51) Int. Cl.
*B63H 25/06* (2006.01)

(52) U.S. Cl. ..... 114/162; 114/144 R

(58) Field of Classification Search ..... 114/150, 114/162, 163, 144 R; 440/53, 61 B, 61 R, 440/61 S, 65

See application file for complete search history.

(56) References Cited

U.S. PATENT DOCUMENTS 3,073,275 A * 1/1963 Fenzl et al. ..... 114/150
3,147,730 A * 9/1964 Specht ..... 114/163
5,628,268 A 5/1997 Brydel et al.
6,026,759 A * 2/2000 Hazelett et al. ..... 114/163

OTHER PUBLICATIONS

Rolls-Royce: Marine; *Product Range: Motion Control: Steering Gear: Tenfjord Rotary Vane Steering Gear* (visited Jul. 14, 2006) (1 page) http://www.rolls-royce.com/marine/product/motion/steer/tenfjord.jsp.

Rolls-Royce Marine; *Product Range: Motion Control: Steering Gear* (visited Jul. 14, 2006) (2 pages) http://www.rolls-royce.com/marine/product/motion/steer/default.jsp.

Rolls-Royce Marine; *Product Range: Motion Control: Steering Gear: Frydenbö Rotary Vane Steering Gear* (visited Jul. 14, 2006) (2 pages) http://www.rolls-royce.com/marine/product/motion/steer/frydenbo.jsp.

Rolls-Royce® Fact Sheet; The Frydenbö Range.

* cited by examiner

*Primary Examiner*—Lars A Olson
(74) *Attorney, Agent, or Firm*—Alston & Bird LLP

(57) ABSTRACT

A steering system for a vessel is provided. The steering system includes an electric motor assembly and a steering linkage for transmitting the rotational output of the electric motor assembly to the vessel's rudder. The steering system may include at least three linkage members. The steering system may provide a variable output torque that corresponds at least partially with the variable required torque of the rudder at different rudder angles. The steering system may partially decouple the electric motor assembly from vertical movements in the rudder. Embodiments may include additional motor assemblies and steering linkages. The additional motor assemblies and steering linkages may provide an opposing force to reduce flutter within the system and/or be used to reduce the load of any one electric motor assembly.

9 Claims, 8 Drawing Sheets

STEERING SYSTEM AND AN ASSOCIATED VESSEL

BACKGROUND OF THE INVENTION

Rudders are used in variety of vessels, such as many types and classes of ships, for controlling and manipulating the direction of the vessels. Typically, the rudder extends below or behind the hull of the vessel. The direction of the vessel is controlled by rotating or turning the rudder. Turning and holding a vessel's rudder may be referred to as rudder actuation.

A variety of hydraulic mechanisms exist for rudder actuation including rapson slides, link types, articulated cylinders, rotary vanes, and hydraulic rotaries. In general, the hydraulic mechanisms are mounted directly to a vertical shaft of the rudder, referred to as a rudder stock, or indirectly through one or more tillers. For example in a rotary vane 10 as shown in FIG. 1, a number of vanes 12 are coupled to the rudder stock 14 such that the turning of the vanes 12 by the application of hydraulic pressure turns the rudder stock 14. As another example in a rapson slide 20 as shown in FIG. 2, a pair of opposing hydraulic cylinders 22, 24 are coupled to a tiller 26 for moving the tiller 26 back and forth such that tiller 26 turns the rudder stock. Other hydraulic mechanisms may include a rack driven by one or more hydraulic cylinders or pumps and a pinion coupled directly to the rudder stock.

Although hydraulic mechanisms are capable of producing the large forces required for rudder actuation, hydraulic mechanisms also have disadvantages and shortcomings. For example, the hydraulic fluids inherent to such mechanisms are potential environmental and safety liabilities. Many of the hydraulic mechanisms are relatively heavy and noisy. Moreover, most hydraulic mechanisms are maintenance intensive and often require the vessel to carry additional crew members for maintaining the hydraulic mechanisms. Another issue with hydraulic mechanisms, especially ones directly coupled to the rudder stock, is the overall steering system's resistance to shock. More specifically, a variety of sources, such as a grounding or an underwater explosion, may cause the rudder stock to move up and down relative to the ship's hull. The vertical movement of the rudder stock may be referred to as a rudder stock excursion. The direct coupling of the hydraulic or another other type of drive mechanisms to the rudder stock creates a problem during a rudder stock excursion because the movement of the rudder stock directly transfers stress loads onto components of the drive mechanisms. The problem is especially acute in many of the hydraulic mechanisms that require relative tight tolerances. In such mechanisms a relatively small displacement between components can severally degrade the performance of the steering system or lead to more lengthy and expensive maintenance. To protect against rudder stock excursions some known hydraulic mechanisms use components that are especially hardened or processed to better withstand some of the stress loads. However, such components increase the overall cost, weight, size, and complexity of the hydraulic mechanism and the steering system as a whole.

In light of the foregoing it would be desirable to provide a steering mechanism for a vessel that is not driven by hydraulics. Also, it would be desirable if the steering mechanism was easier to assemble and maintain than many of the known hydraulic mechanisms. Other desirable characteristics may include relatively lighter, quieter, and improved shock resistance compared to at least some of the known hydraulic systems.

BRIEF SUMMARY OF THE INVENTION

Embodiments of the present invention address the above needs and achieve other advantages by providing a steering system for a vessel that includes an electric motor assembly and a steering linkage for transmitting the rotational output of the electric motor assembly to the vessel's rudder. The steering system may provide a variable output torque that corresponds at least partially with a variable required torque for actuating the rudder at different rudder angles. Also, the steering system may partially decouple the electric motor assembly from vertical movements in the rudder and thus provide an enhanced shock resistance to the steering system. The steering system also provides an electric motor assembly or assemblies that are separated from the rudder allowing for easier maintenance of the system. Embodiments of the steering system with multiple motor assemblies may be configured to reduce rudder vibration and thus help reduce noise within the steering system. Moreover, multiple motor assemblies reduce the load on any one electric motor assembly.

For example, according to embodiments of the present invention, the steering system includes an electric motor assembly for generating a rotational output, a rudder that defines a rudder angle relative to the length of a vessel, and a steering linkage for transmitting the rotational output of the electric motor assembly to the rudder in order to control the rudder angle.

The steering linkage may have at least a first linkage member, a second linkage member, and a third linkage member. The first linkage member may extend between the electric motor assembly and the second linkage member. The second linkage member may extend between the first linkage member and the third linkage member. And the third linkage member may extend between the second linkage member and the rudder. Each of the first, second, and third linkage members defines a length. The length of the third linkage member may be less than or greater than the length of the first linkage member. One or more of the linkage members may comprise a structural steel or a vibration absorbing material or any other material of sufficient mechanical properties.

The rudder may further define an axis of rotation. The first, second, and third linkage members may be coupled together such that movement of one of the linkage members within a first plane generally perpendicular to the axis of rotation of the rudder encourages movement of the other linkage members within the first plane or another plane parallel to the first plane. And at least two of the linkage members may be coupled together such that one of the linkage members is at least partially isolated from movement of the other linkage member within a second plane generally parallel to the axis of rotation of rudder. For example, the steering linkage may further comprise a spherical bearing for coupling at least two of the linkage members together.

The steering linkage and the rudder may be configured to operate within a range of positions and the steering linkage may define a mechanical advantage that varies within the range of the positions. Moreover, a required torque for altering the rudder angle may increase at least partially with an increase in rudder angle, and the mechanical advantage of the steering linkage may increase at least partially with the increase in rudder angle. For example, a maximum mechanical advantage of the steering linkage may correspond substantially with a maximum required torque The steering system may further include a second electric motor assembly and a second steering linkage for coupling a second rotational output of the second electric motor assembly to the rudder. The first electric motor assembly and the first steering linkage may exert a first output torque onto the rudder and the second electric motor assembly and the second steering linkage may exert a second output torque onto the rudder. The first and second output torques may oppose each other at one or more positions of the rudder.

The steering system may further comprise additional motor assemblies and additional steering linkage for coupling additional rotational outputs to the rudder.

Other embodiments of the present invention may include a vessel having a vessel body and one or more of the steering systems. The steering system includes an electric motor assembly for generating a rotational output, a rudder that defines a rudder angle relative to the length of the vessel, and a steering linkage for transmitting the rotational output of the electric motor assembly to the rudder in order to control the rudder angle. The vessel body may comprise a ship hull.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF SELECTED PREFERRED EMBODIMENTS

Figure 1:
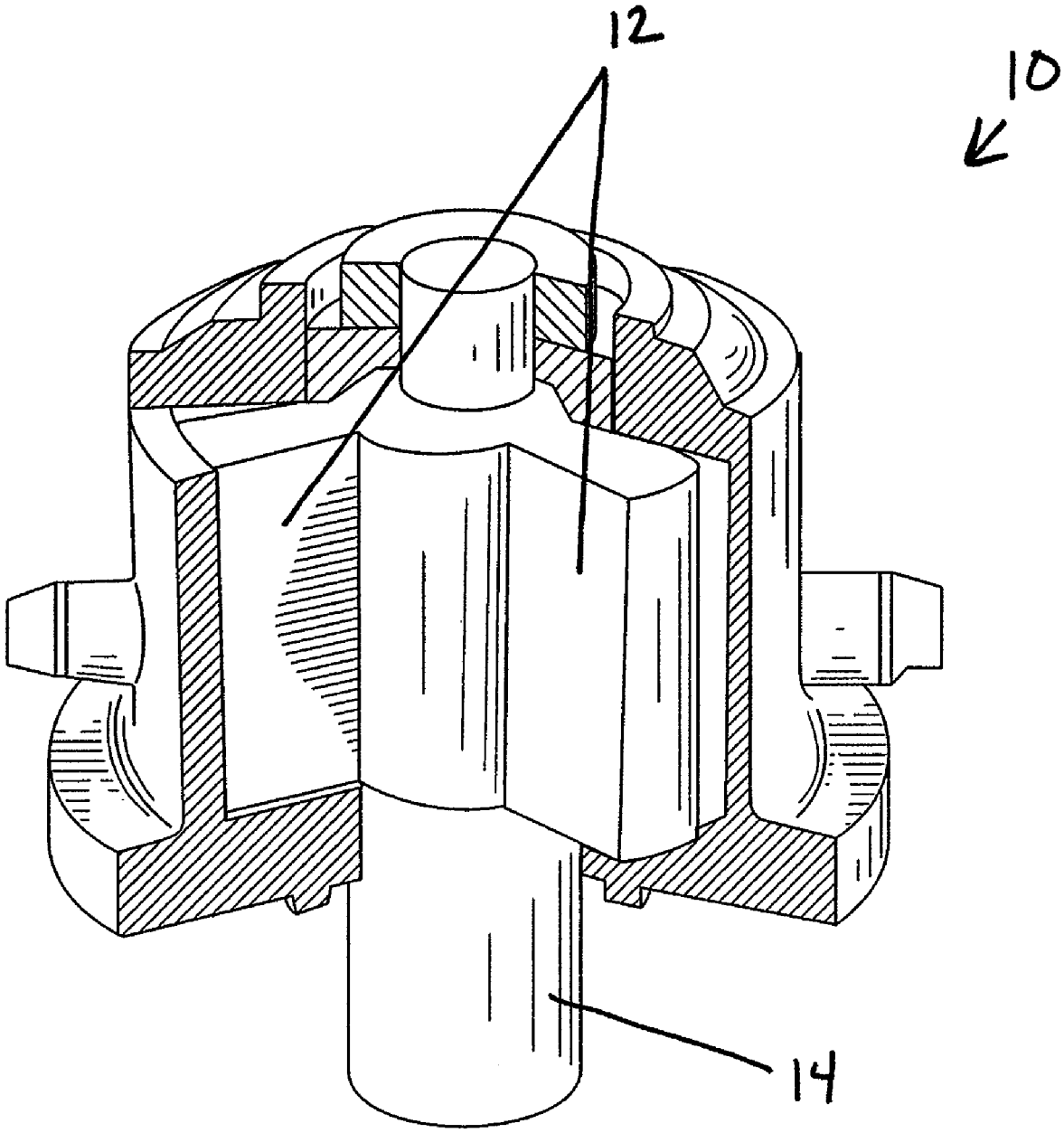
FIG. 1 (PRIOR ART)
FIG. 1 is a perspective view of a known hydraulically-driven rotary vane.
Figure 2:
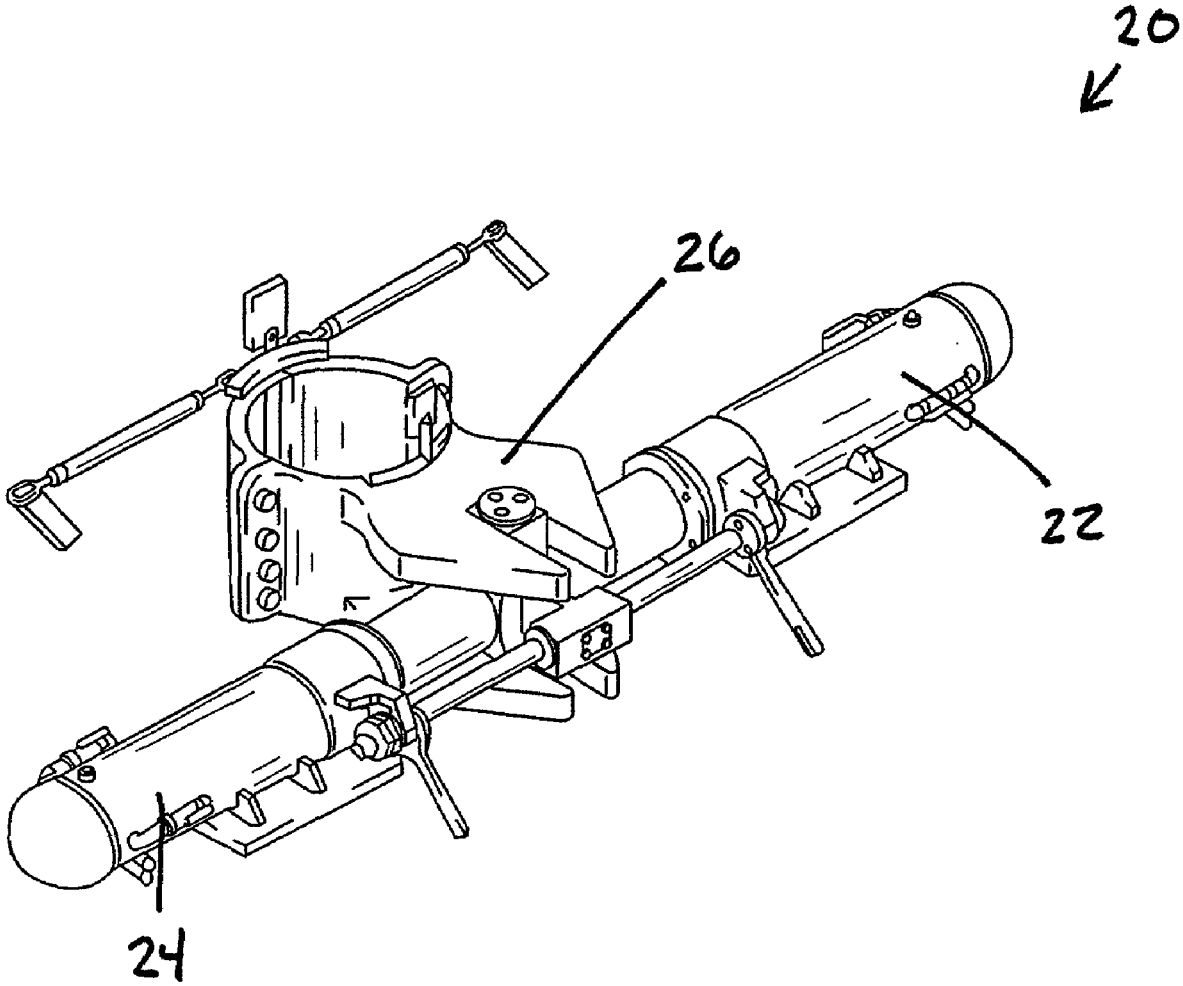
FIG. 2 (PRIOR ART)
FIG. 2 is a perspective view of a known hydraulically-driven rapson.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

According to an embodiment of the present invention, a steering system 30 for a vessel is provided. The steering system 30 may include an electric motor assembly 32, a steering linkage 34, and a rudder stock 36. In general, the steering linkage 34 transmits a rotational motion of the electric motor assembly 32 to the rudder stock 36 for changing the course of the vessel. The vessel may be an airplane, ship, boat, submarine, or any other aircraft or watercraft or artificial contrivance having a vessel body, such as a hull, airframe or the like, and used, or capable of being transported through air, water, or other similar mediums.

The electric motor assembly 32 generally includes an electric motor 38 for generating a rotational output or motion. The type of electric motor may vary. For example, the electric motor may be a permanent magnet, induction or reluctance motor and be AC or DC powered. As more specific example, the motor may be a permanent magnet type utilizing brushless DC or synchronous AC power designs. The power rating or maximum load capacity of the electric motor may depend on the expected maximum torque and maximum speed for actuating the rudder, which in turn may depend from, among other things, the type of vessel, expected operating speed of the vessel and the size of the rudder.

The electric motor assembly 32 may further include one or more gear or speed reducers 40 or other gear trains, such as a planetary gear train, for changing the speed of the rotational output of the electric motor assembly and/or changing the axis of rotation of the output of the electric motor assembly.

Figure 3:
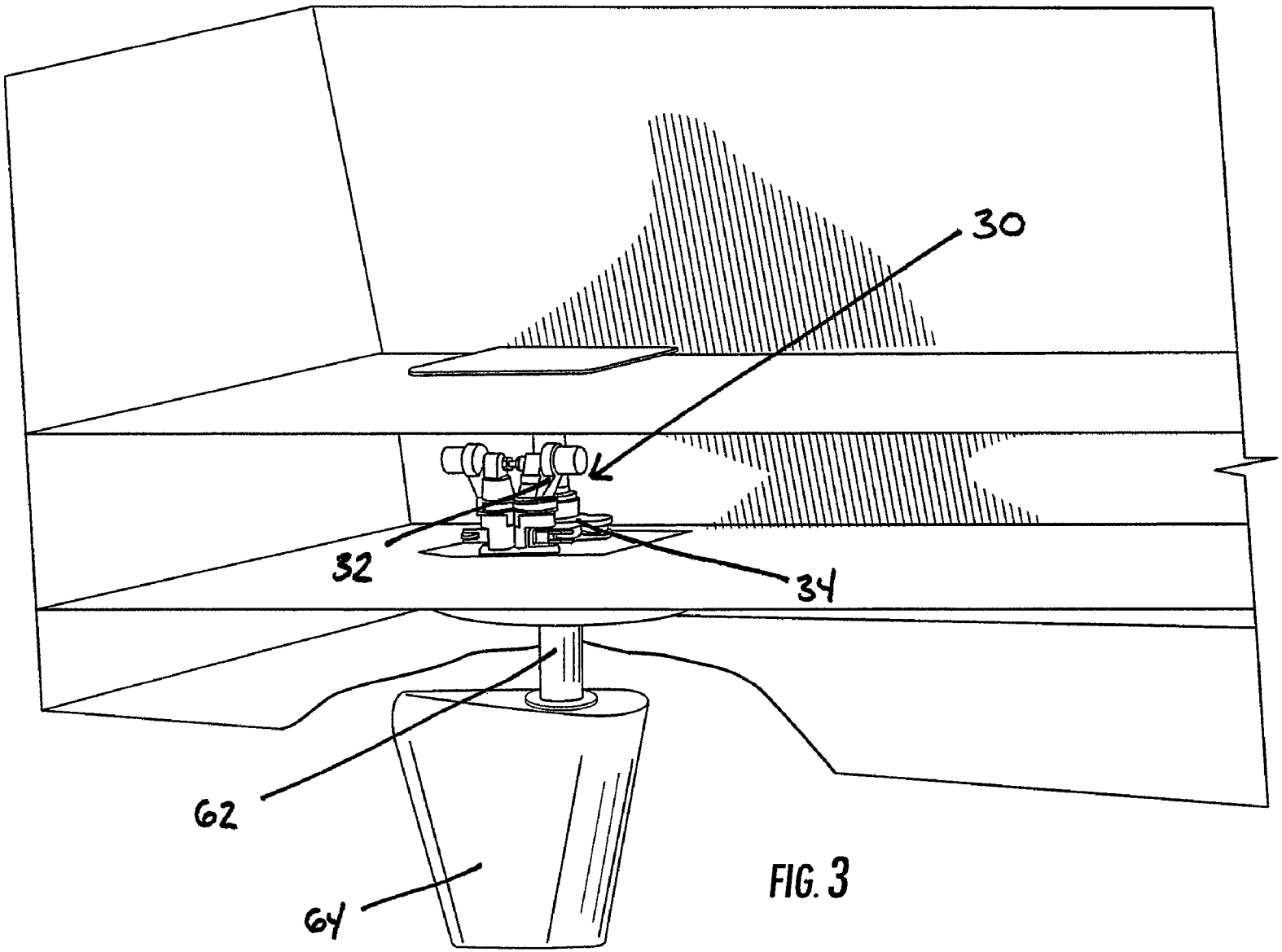
FIG. 3 is a perspective view of a steering system according to an embodiment of the present invention.
Figure 4:
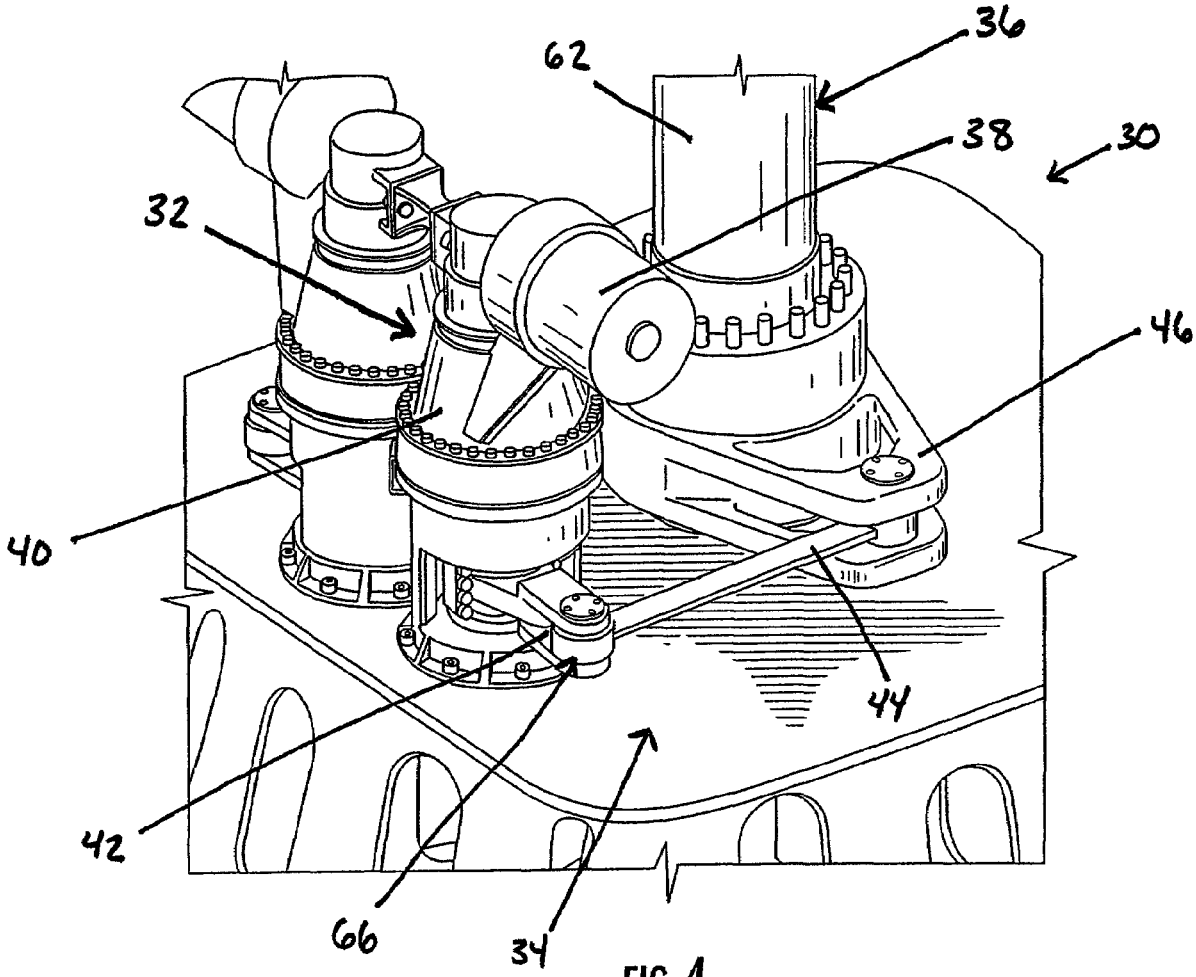
FIG. 4 is an enlarged perspective view of the steering system of FIG. 3.
Figure 5:
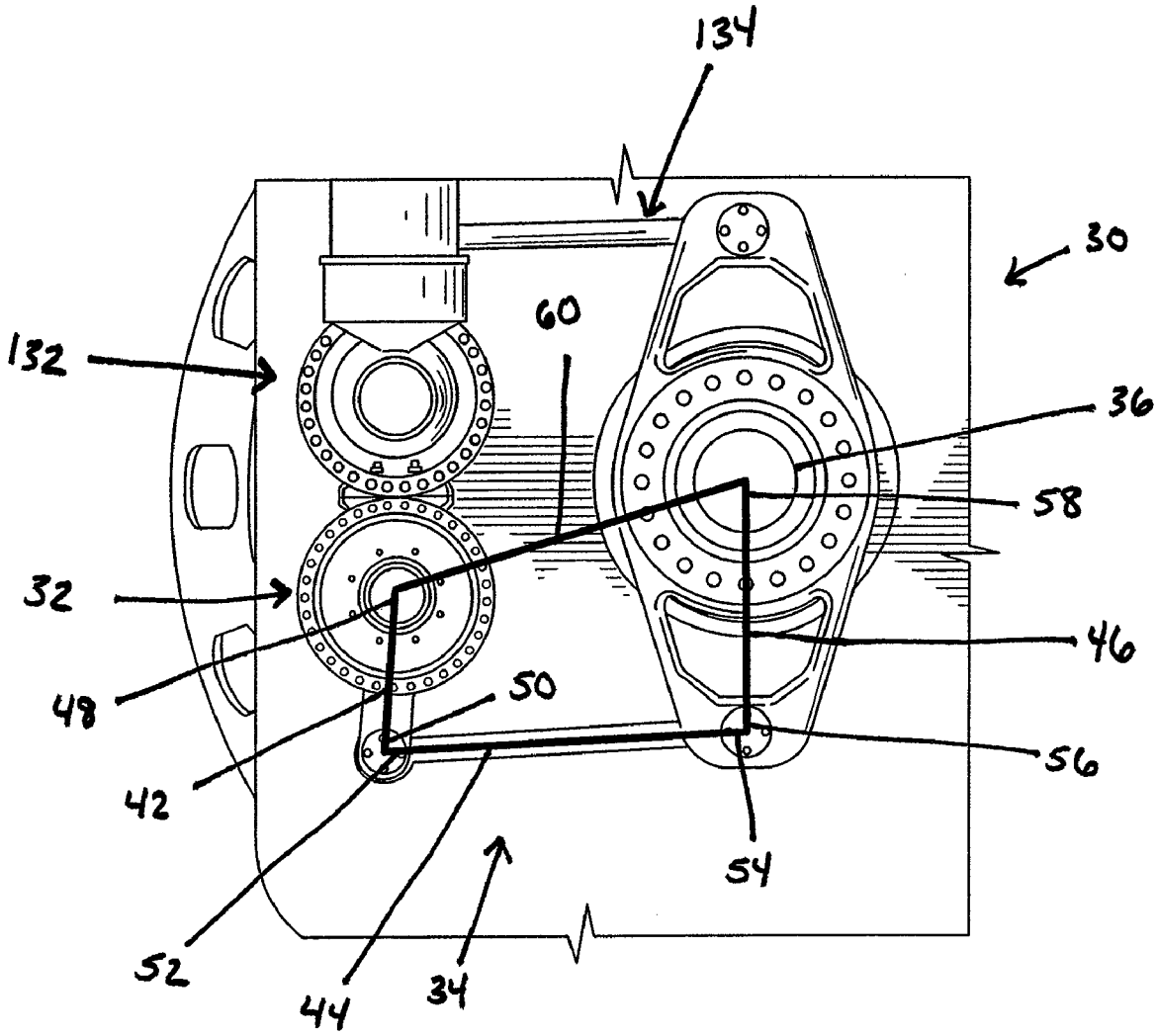
FIG. 5 is a top plan view of the steering system of FIG. 4, with a portion of the electric motor assembly 32 of FIG. 4 removed for illustrative purposes only, and wherein the steering system is in a first position that corresponds to a rudder position of a substantially zero rudder angle.
Figure 6:
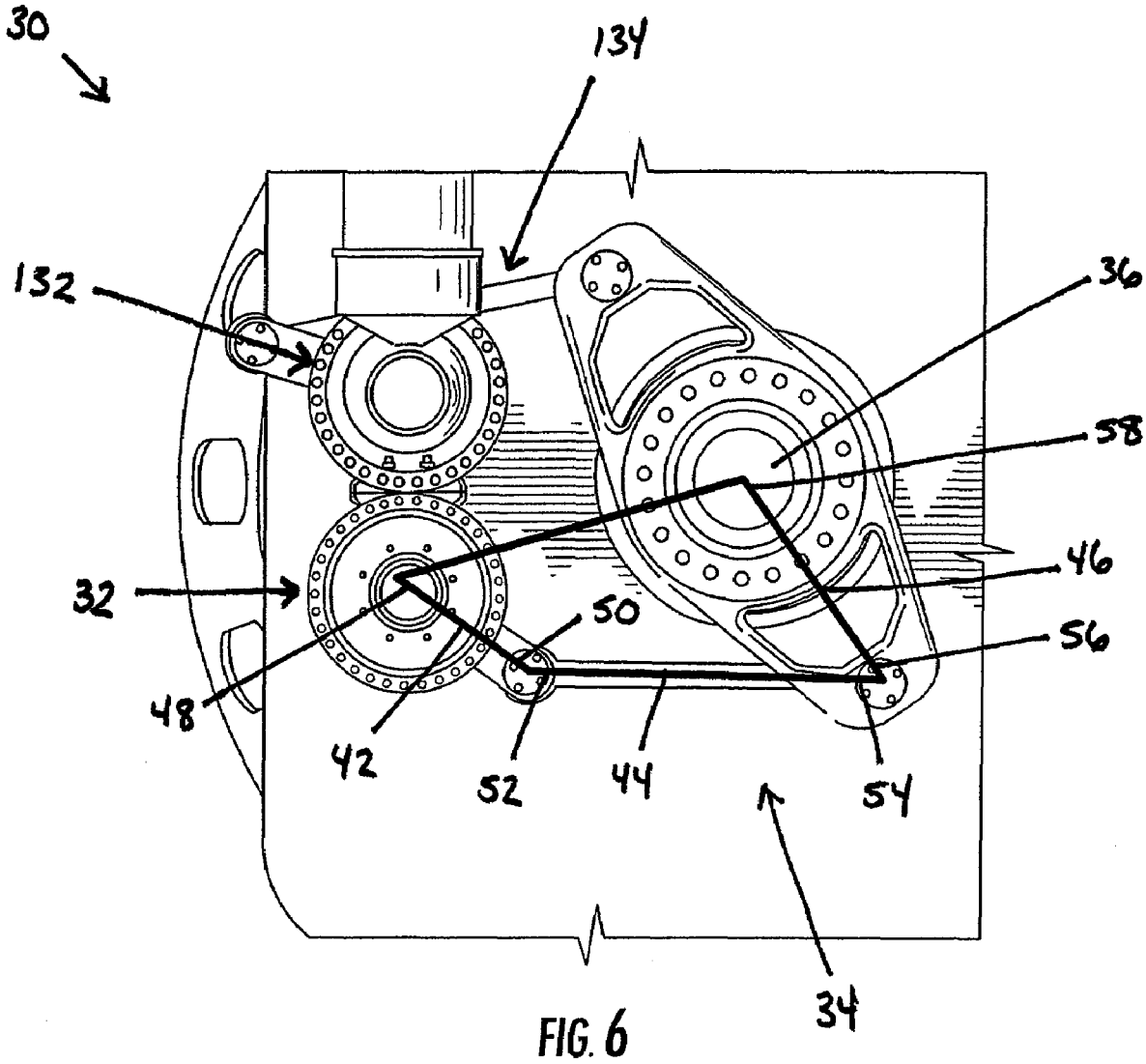
FIG. 6 is a top plan view of the steering system of FIG. 4, with a portion of the electric motor assembly 32 of FIG. 4 removed for illustrative purposes only, and wherein the steering system is in a second position that corresponds to a rudder position of a relative maximum rudder angle.
Figure 7:
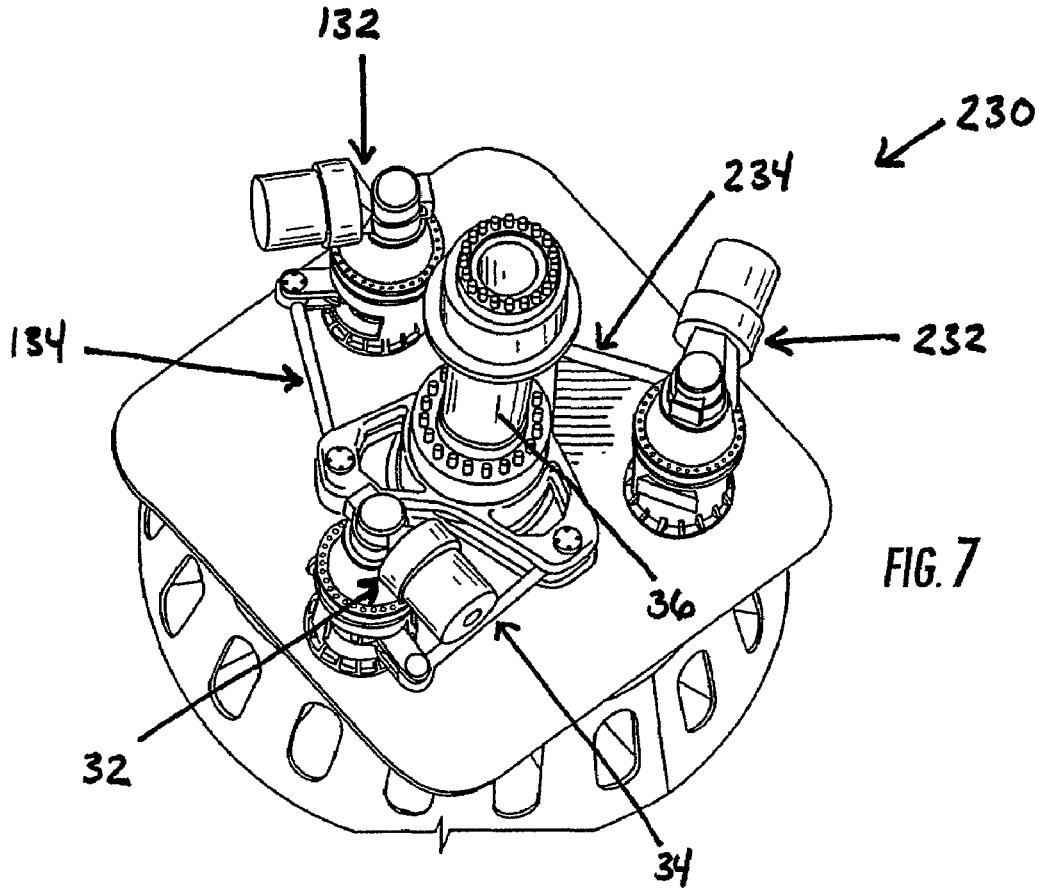
FIG. 7 is a perspective view of a steering system according to another embodiment of the present invention.
Figure 8:
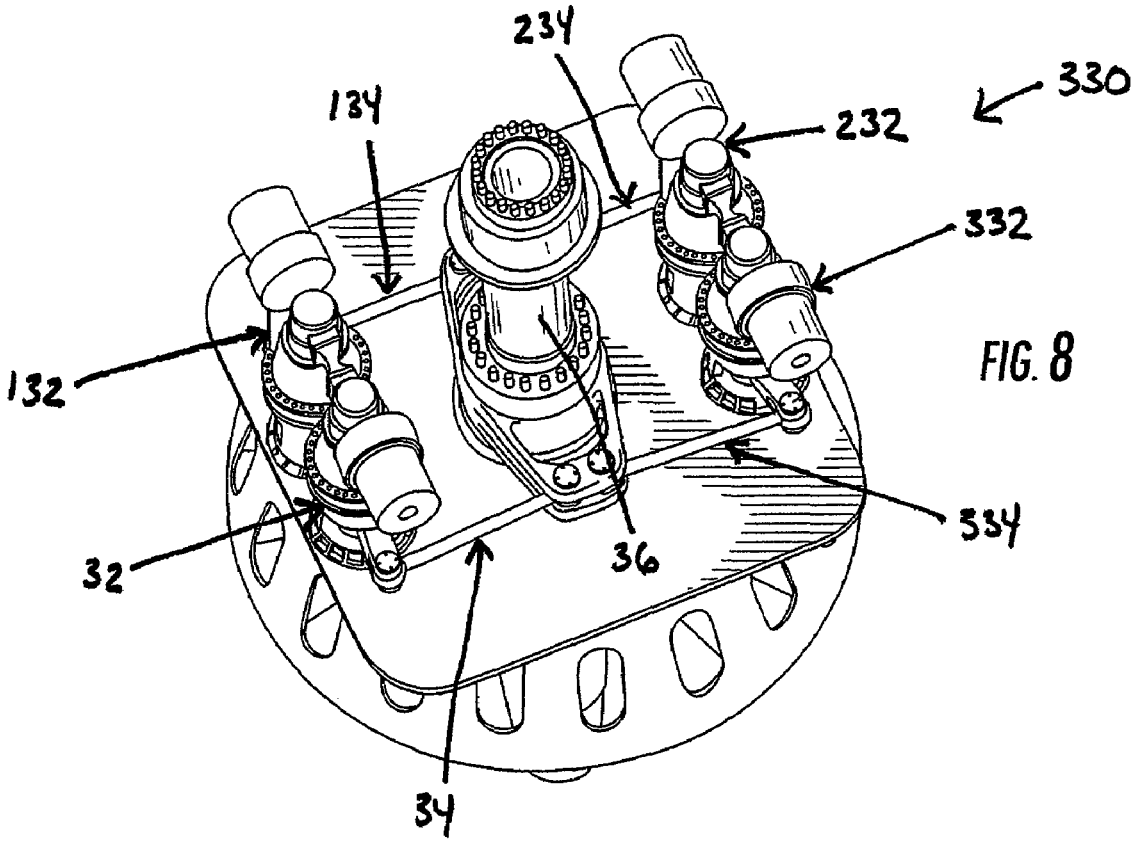
FIG. 8 is a perspective view of a steering system according to yet another embodiment of the present invention.

As shown in the embodiment of the present invention illustrated in FIGS. 3 through 6, the steering linkage 34 may include at least three linkage members, i.e. a drive lever 42, a link bar 44, and a tiller 46. The drive lever 42 extends from a first end 48 coupled to the electric motor assembly 32 toward a second end 50 coupled to the link bar 44. The link bar 44 extends from a first end 52 that is coupled to the second end 50 of the drive member to a second end 54 that is coupled to the tiller 46. The tiller 46 extends from a first end 56 that is coupled to the second end 54 of the link bar to a second end 58 that is coupled to the rudder 36. As illustrated in FIGS. 5 and 6, the structure that supports the electric motor assembly and the rudder may be viewed as a fourth and fixed linkage member 60 of the steering linkage. Thus, in the embodiments of the present invention illustrated in FIGS. 3 through 8, the steering linkage may be considered to function as a four-bar linkage.

As illustrated in FIGS. 5 and 6, the rotational motion of the electric motor assembly 32 is transmitted to the drive lever 42 resulting in the rotational movement of the second end 50 of the drive lever about the electric motor assembly 32 and the creation of an input torque at the second end 50 of the drive lever. The rotational movement of the second end 50 of the drive lever is transmitted to the tiller 46 through the link bar 44 resulting in the rotational movement of the first end 56 of the tiller about the rudder 36 and the creation of an output torque at the first end 56 of the tiller.

The output torque is transmitted to the rudder 36 through the coupling of the second end 58 of the tiller to the rudder 36 and is used to rotate the rudder 36 in order to change the rudder angle. More specifically, the rudder 36 may include a shaft, referred to as a rudder stock 62, and a blade portion 64. As illustrated in FIG. 3, the blade portion 64 extends into the water below and/or behind the hull of the vessel. The rudder stock 62 extends from the blade portion 64 into the hull of the vessel. The blade portion 64 is supported by the rudder stock 62 and the rudder stock is supported within and/or by the hull of the vessel. The rotation of the rudder stock 62 through the rotation of the tiller 26 also rotates the blade portion 64. Therefore the rudder stock 62 also defines an axis of rotation for the rudder 36.

In general, the rudder 36 controls the direction of the vessel by redirecting the flow of water or air past the hull or fuselage of the vessel. More specifically, an operator may redirect the flow of water or air by changing the rudder angle relative to the vessel. While the vessel may be a ship, the vessel may be an aircraft or other vessel as noted above. Thus, the term "rudder" is used generically herein and may also include airfoils, fins, or the other devices for redirecting the flow of water or air depending upon the type of vessel employing the steering system 30. For example, in some embodiments, the vessel may be a ship. When the blade portion 64 of the rudder is substantially parallel to the length of the ship, i.e. from the bow to the stern of the ship, the rudder 36 has a minimal impact on the flow of the water as it passes by the rudder 36. The rudder 36 is held in this parallel position when the operator wants the ship to maintain a particular course, i.e. continue in a straight line. In order to turn or change the direction of the ship, the operator may change the angle of the blade portion 64 relative to the length of the ship, referred to as the rudder angle. The more the blade portion 64 is moved from a parallel position, i.e. rudder angle of 0°, toward a perpendicular position, i.e. rudder angle of 90°, the more the rudder 36 redirects the flow of water and creates a turning or yawing motion for the ship allowing the operator to change the direction of the ship.

Turning the rudder 36 and holding it in place while the ship is underway may require a large amount of force, especially for larger ships, such as freighters, naval warships, and cruise ships. And controlling the ship's rudder 36 is essential to the operation of ship, regardless of the size of the ship. The basic characteristics of the forces required to turn and hold a vessel's rudder 36 are known. For example, when the vessel is underway, the force required to turn the rudder 36 increases exponentially as the rudder angle increases as shown in FIG. 9.

Figure 9:
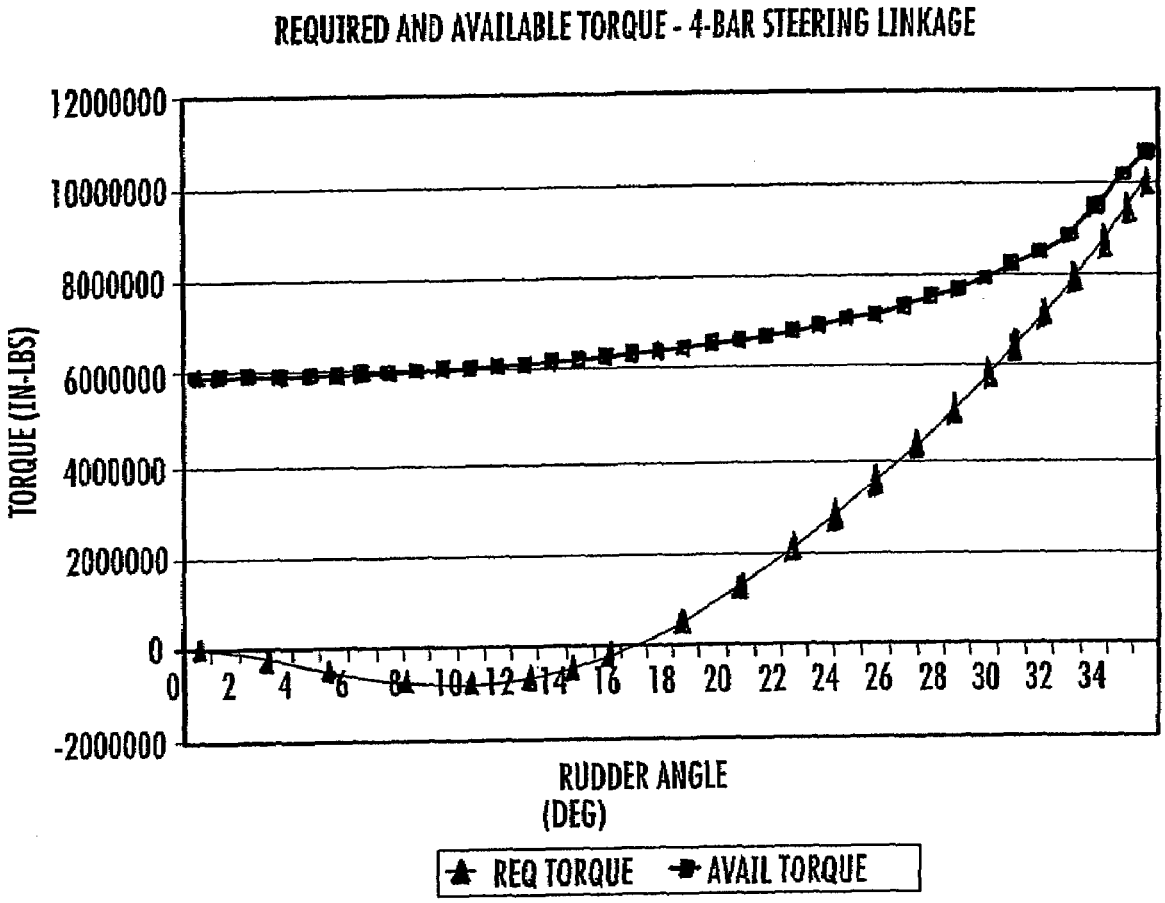
FIG. 9 is a chart illustrating an example of required torque versus available output torque of a steering linkage according to an embodiment of the present invention.

According to embodiments of the present invention and as shown in FIG. 9, the potential available output torque of the steering linkage 34 may vary as well. In particular, the steering linkage 34 may have a mechanical advantage between the input torque at the drive lever 42 and the output torque at the tiller 46. "Mechanical advantage" as used herein is the ratio of the outer torque exerted by the tiller 46 to the input torque exerted on the drive lever 42. The mechanical advantage is dependent on the angles between the drive lever 42, the link bar 44, and the tiller 46 and the relative lengths of the drive lever 42 and the tiller 46. In general, the mechanical advantage is directly proportional to the sine of the angle between the link bar 44 and the tiller 46, referred to herein as the transmission angle, and inversely proportional to the sine of the angle between the drive lever 42 and the link bar 44. Because the angles between the drive lever 42, the link bar 44, and the tiller 46 vary during operations the mechanical advantage varies as well. Therefore, in an embodiment, where the input torque remains substantially constant, such as when the electric motor assembly 32 is operating in a steady state, the output torque of the tiller 46 varies with the mechanical advantage.

As indicated in FIG. 9, the steering linkage 34 may be configured such that variation in the available output torque of the tiller 46 corresponds at least partially with the variation of the required torque to actuate the rudder 46 at different rudder angles. For example, both the output torque and the required torque may vary within a range between minimum values and maximum values. The relatively higher values of the output torque may correspond to the relatively higher values of the required torque. And the relatively lower values of the output torque may correspond to the lower values of the required torque.

As a further example, FIG. 5 illustrates a steering linkage 34 in a first position. In this position, due to the angles between the drive lever 42, the link bar 44, and the tiller 46, the steering linkage 34 has a relatively minimum mechanical advantage. The mechanical advantage that does exist in this first position is primarily from the relative length of the drive lever 42 and the tiller 46, i.e. the drive lever is shorter. Although the first position has a minimum mechanical advantage, the first position corresponds to a first rudder position having a substantially zero rudder angle. Therefore the required torque to actuate the rudder 36 is also at a relatively low value, as indicated in FIG. 9.

Conversely, as shown in FIG. 6, as the steering linkage 34 drives the rudder 36 toward a second rudder position having a relatively maximum rudder angle and thus a relative maximum required torque, the angle between the link bar 44 and the drive lever 42 approaches 180° which exponentially increases the mechanical advantage and thus the output torque to relatively maximum values. In other words, the relatively maximum value of the output torque corresponds to the relatively maximum value of the required torque.

The drive lever 42, the link bar 44, and the tiller 46 may comprise of various materials having adequate structural strength and fatigue properties to withstand the forces and movement between the linkage members of the steering linkage 34 the rudder 36 and the electric motor assembly 32. For example, one or more of the drive lever, the link bar, and the tiller may comprise a structural steel. Other examples include, but are not limited to, carbon/carbon fiber composite, cast iron, and bronze.

Another consideration for material selection may be noise. In some embodiments, such as naval vessels, it may be desirable to control or reduce any noise produced from the steering system 30. The steering system 30 may include noise absorbing mechanisms or structures. Also, in some embodiments, one or more of the linkage members of the steering linkage 34 may comprise a material for reducing or absorbing vibrations and thus minimizing noise. For example, the link bar 44 may comprise a carbon fiber material or other material configured to absorb vibrations within the steering linkage.

The drive lever 42, the link bar 44, and the tiller 46 may be coupled together by any fastener, bearing and/or other direct or indirect connection that facilitates the joint movement of the drive lever 42, the link bar 44, and the tiller 46 within at least a first plane substantially perpendicular to the rudder stock 14 or planes parallel to the first plane. Moreover, the drive lever 42, the link bar 44, and the tiller 46 may be coupled such that any movement in this first plane by any one of the linkage members encourages a reactive movement by the other linkage members.

However, according to some embodiments, the coupling between one or more of the drive lever 42, the link bar 44, and the tiller 46 may be configured to minimize or decouple one or more of the linkage members 42, 44, 46 from movement by other linkage members or the rudder stock 62 within at least a second plane that is not parallel to the first plane.

For example and as previously discussed, a variety of sources, such as a grounding or an underwater explosion, may cause the rudder stock 62 to move up and down relative to the ship hull. The vertical movement of the rudder stock 62 may be referred to as a rudder stock excursion. The vertical movement of the rudder stock 62 is generally perpendicular to the first plane in which the steering linkage 34 is configured to move within. The coupling of the rudder stock 62 to the tiller 46 and thus the other linkage members 42, 44 may cause the vertical movement of the rudder stock 62 to be transmitted to and through the steering linkage 34. Moreover, the vertical movement may be transmitted to the electric motor assembly 32.

To minimize or prevent the vertical movement transmission back through the steering linkage 34, one or more the linkage members 42, 44, 46 may be moveable at least partially in the vertical direction independently from the other linkage members 42, 44, 46. According to an embodiment of the present invention, the link bar 44 is coupled to the drive lever by a spherical bearing 66, which allows the second end 54 of the link bar to move upwards, i.e. generally perpendicular from the first plane, and the first end 52 of the link bar to rotate at least partially upwards from the drive lever 42 such that the force on the drive lever 42 to move upwards with the link bar 44 is reduced or eliminated. Spherical bearings is one example of a connection that allows for at least partially decoupling between the linkage members for movements outside the first plane or planes parallel to the first plane. Other examples include, but are not limited to, using a pivot pin that extends through adjacent ends of two of the linkage members that allows for the coupled movement within the first plane or other planes parallel to the first plane. The length of the pivot pin may be long enough to allow one the linkage members to move along the pivot pin, i.e. in a direction generally perpendicular to the first plane, partially independently from the other linkage members. In addition to or instead of partially decoupling adjacent linkage members, the coupling between the rudder stock and the tiller may allow for the tiller to be at least partially isolated from movement of the rudder stock outside the first plane or a plane parallel to the first plane.

As illustrated in FIG. 4 through 6, the steering system 30 may include a second electric motor assembly 132 and a second steering linkage 134. As with the first electric motor assembly 32 and first steering linkage 34, the second steering linkage 134 is configured to transmit a rotational motion of the second electric motor assembly 132 to control and change the rudder angle. The second electric motor assembly 132 and the second steering linkage 134 may work with the first electric motor assembly 32 and the first steering linkage 34 to exert an opposing torque onto the rudder either throughout the range of rudder angles or at specific points within the range.

For example, as shown in FIG. 9, the range of the rudder angles may include at least one neutral point, where the required torque on the rudder is substantially zero. In such a condition, the rudder may vibrate from turbulence created by the ship's propeller or other sources. Vibration with the rudder, referred to as flutter, may transmit through the steering system and create noise. Exerting an opposing torque against the rudder 36, as described above in the two motor assemblies 32, 132 and two steering linkages 34, 134 embodiment, may facilitate the holding of the rudder near a neutral point and reduce the likelihood or magnitude of flutter.

The steering system may further include additional motor assemblies and steering linkages. For example, according to the embodiment illustrated in FIG. 7, the steering system 230 may include a third electric motor assembly 232 and a third steering linkage 234. As another example, according to the embodiment illustrated in FIG. 8, the steering system 330 may include a fourth electric motor assembly 332 and a fourth steering linkage 334. The additional motor assemblies may be used to reduce the required load per electric motor assembly, including reducing the load on the gear reducers within the motor assemblies.

In embodiments having multiple motor assemblies and steering linkages, the tiller of each of the steering linkages may be an integrated component as illustrated. In other embodiments, the tiller of each of the steering linkages may be coupled to the rudder stock individually.

Embodiments of the present invention may have one or more advantages. For example, the steering system may provide a variable output torque that corresponds at least partially with the variable required torque of the rudder at different rudder angles. Also, the steering system may be partially decoupled from vertical movements in the rudder and thus provide an enhanced shock resistance to the steering system. The separation of the electric motor assembly or assemblies to the rudder may allow for easier assembly, installation, and maintenance of the system. Embodiments including multiple motor assemblies may reduce rudder vibration and thus help reduce noise within the system. Moreover, multiple motor assemblies reduce the load on any one electric motor assembly and provide redundancy against component failures. Also the use of pivot pins to couple the components of the steering linkage according to some of the embodiments of the present invention may facilitate for a more rapid decoupling of failed components.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A steering system for a vessel comprising:

an electric motor assembly for generating a rotational output;

a rudder defining a rudder angle relative to a length of the vessel; and a steering linkage configured to transmit the rotational output of the electric motor assembly to the rudder in order to control the rudder angle, the steering linkage having at least a first linkage member, a second linkage member, and a third linkage member; and wherein the first linkage member extends between the electric motor assembly and the second linkage member; the second linkage member extends between the first linkage member and the third linkage member; and the third linkage member extends between the second linkage member and the rudder such that the rotational output is transmitted from the electric motor assembly through at least the first, second, and third linkage members to the rudder; and wherein the rudder further defines an axis of rotation and wherein the first, second, and third linkage members are coupled together such that movement of one of the linkage members within a first plane generally perpendicular to the axis of rotation of the rudder encourages movement of the other linkage members within the first plane or another plane parallel to the first plane and wherein at least two of the linkage members are coupled together such that one of the linkage members is at least partially isolated from movement of the other linkage member within a second plane generally parallel to the axis of rotation of rudder.

2. A steering system according to claim 1, wherein the steerage linkage further comprises a spherical bearing for coupling at least two of the linkage members together.

3. A steering system for a vessel comprising:

an electric motor assembly for generating a rotational output;

a rudder defining a rudder angle relative to a length of the vessel;

a steering linkage configured to transmit the rotational output of the electric motor assembly to the rudder for altering the rudder angle;

wherein a required torque for altering the rudder angle varies relative to a value of the rudder angle, and the steering linkage defines a mechanical advantage that varies and corresponds at least partially with the required torque wherein the steering linkage includes at least a drive lever, a link bar, and a tiller, wherein the drive lever extends from at least the electric motor assembly to at least the link bar, the link bar extends from at least the drive lever to at least the tiller, and the tiller extends from at least the link bar to at least the rudder wherein the electric motor assembly includes an electric motor and a gear reducer for modifying the speed of the rotational output and the rudder includes a rudder stock extending into the vessel and a blade portion extending outside the vessel; and wherein the rudder stock defines an axis of rotation of the rudder and wherein the link bar is coupled to the drive lever such that movement of the drive lever within a first plane generally perpendicular to the axis of rotation of the rudder encourages movement of the link bar within the first plane and wherein the drive lever is at least partially isolated from movement of the link bar within a second plane generally parallel to the axis of rotation of the rudder.

4. A steering system according to claim 3, wherein the steerage linkage further comprises a spherical bearing for coupling at least two of the linkage members together.

5. A steering system according to claim 3, wherein the steerage linkage further comprises a pivot pin for coupling at least two of the linkage members together.

6. A steering system according to claim 3, wherein the link bar comprises a vibration absorbing material.

7. A vessel comprising:

a vessel body; and a steering system for guiding the vessel, the steering system includes:

a rudder defining a rudder angle relative to a length of the vessel body;

an electric motor assembly for generating a rotational output; and a steering linkage configured to transmit the rotational output of the electric motor assembly to the rudder in order to control the rudder angle, the steering linkage having at least a first linkage member, a second linkage member, and a third linkage member; and wherein the first linkage member extends between the electric motor assembly and the second linkage member; the second linkage member extends between the first linkage member and the third linkage member; and the third linkage member extends between the second linkage member and the rudder such that the rotational output is transmitted from the electric motor assembly through at least the first, second, and third linkage members to the rudder and wherein the rudder further defines an axis of rotation and wherein the first, second, and third linkage members are coupled together such that movement of one of the linkage members within a first plane generally perpendicular to the axis of rotation of the rudder encourages movement of the other linkage members within the first plane or another plane parallel to the first plane and wherein at least two of the linkage members are coupled together such that one of the linkage members is at least partially isolated from movement of the other linkage member within a second plane generally parallel to the axis of rotation of rudder.

8. A vessel according to claim 7, wherein the steering system further includes at least a second electric motor assembly and at least a second steering linkage configured to couple a second rotational output of the second electric motor assembly to the rudder.

9. A vessel according to claim 7, wherein the vessel body comprises a ship hull.

* * * * *